US011566473B2

(12) United States Patent
Guerra et al.

(10) Patent No.: US 11,566,473 B2
(45) Date of Patent: Jan. 31, 2023

(54) HORIZONTAL DIRECTIONAL REAMING

(71) Applicant: QUANTA ASSOCIATES, L.P., Houston, TX (US)

(72) Inventors: Pablo Guerra, Houston, TX (US); Jason Steph, Houston, TX (US)

(73) Assignee: Quanta Associates, L.P., Houston, TX (US)

( * ) Notice: Subject to any disclaimer, the term of this patent is extended or adjusted under 35 U.S.C. 154(b) by 0 days.

(21) Appl. No.: 16/425,724

(22) Filed: May 29, 2019

(65) Prior Publication Data

US 2019/0368273 A1 Dec. 5, 2019

Related U.S. Application Data

(60) Provisional application No. 62/677,302, filed on May 29, 2018.

(51) Int. Cl.

| | |
|---|---|
| ***E21B 10/28*** | (2006.01) |
| ***E21B 7/28*** | (2006.01) |
| ***E21B 7/04*** | (2006.01) |

(52) U.S. Cl.

CPC ..... *E21B 7/28* (2013.01); *E21B 7/046* (2013.01); *E21B 10/28* (2013.01)

(58) Field of Classification Search

CPC ..... E21B 10/12; E21B 10/20; E21B 10/22; E21B 10/26; E21B 10/28; E21B 7/28; E21B 7/046

See application file for complete search history.

(56) References Cited

U.S. PATENT DOCUMENTS 1,847,981 A * 3/1932 Reed ..... E21B 10/20 175/369
2,704,204 A * 3/1955 Koontz ..... E21B 10/28 175/370

(Continued)

FOREIGN PATENT DOCUMENTS

CA 2786820 10/2016
CN 104126049 A * 10/2014 ..... E21B 10/30

(Continued)

OTHER PUBLICATIONS

Copenheaver, Blaine R., International Search Report for PCT/US2019/034446, dated Aug. 2, 2019, 3 pages, ISA/US, Alexandria, Virginia.

(Continued)

*Primary Examiner* — Jennifer H Gay
(74) *Attorney, Agent, or Firm* — Oathout Law Firm; Mark A. Oathout; Elizabeth Gray

(57) ABSTRACT

The disclosure relates to embodiments of horizontal directional drilling equipment and methods for horizontal directional drilling techniques including a reamer head comprising a frustoconical body, wherein the frustoconical body defines a cavity configured to receive at least one bearing; and a plurality of teeth mounted to the frustoconical body. An imaginary apex of the frustoconical body is superimposed on the centerline of a reamer or reaming apparatus for reaming of an underground arcuate path. In another embodiment the reamer head is a progressive independently segmented reaming head. A plurality reaming heads are mounted to a reaming apparatus for reaming of an underground arcuate path.

6 Claims, 9 Drawing Sheets

(56) References Cited

U.S. PATENT DOCUMENTS

| | | | | |
|---|---|---|---|---|
| 2,873,093 | A * | 2/1959 | Hildebrandt | E21B 6/00 175/92 |
| 2,887,301 | A * | 5/1959 | Day | E21B 10/28 175/334 |
| 3,094,177 | A * | 6/1963 | Williams, Jr. | E21B 10/08 175/334 |
| 3,726,350 | A * | 4/1973 | Pessier | E21B 10/08 175/374 |
| 4,316,515 | A | 2/1982 | Pessier | |
| 5,282,512 | A | 2/1994 | Besson et al. | |
| 5,341,890 | A | 8/1994 | Cawthorne et al. | |
| 5,456,328 | A * | 10/1995 | Saxman | E21B 10/10 175/376 |
| 5,592,995 | A | 1/1997 | Scott et al. | |
| 5,746,280 | A | 5/1998 | Scott et al. | |
| 5,890,552 | A | 4/1999 | Scott et al. | |
| 7,137,460 | B2 | 11/2006 | Slaughter, Jr. et al. | |
| 7,152,702 | B1 | 12/2006 | Bhome et al. | |
| 7,320,375 | B2 * | 1/2008 | Singh | E21B 10/16 175/331 |
| 7,686,104 | B2 | 3/2010 | Singh et al. | |
| 7,798,255 | B2 | 9/2010 | Gatell et al. | |
| 8,356,398 | B2 | 1/2013 | McCormick et al. | |
| 8,579,050 | B2 * | 11/2013 | Pessier | E21B 10/28 175/344 |
| 9,611,698 | B2 * | 4/2017 | Maher | B23P 6/00 |
| 10,364,611 | B2 * | 7/2019 | Lubberger | E21B 10/28 |
| 10,876,657 | B2 | 12/2020 | Guerra | |
| 10,914,121 | B2 | 2/2021 | Halderman et al. | |
| 11,035,185 | B2 | 6/2021 | Halderman et al. | |
| 2002/0108785 | A1 | 8/2002 | Slaughter, Jr. et al. | |
| 2006/0249311 | A1 | 11/2006 | Thuresson | |
| 2006/0260848 | A1 | 11/2006 | Fyfe | |
| 2007/0017709 | A1 * | 1/2007 | Singh | E21B 10/16 175/365 |
| 2009/0159341 | A1 | 6/2009 | Pessier et al. | |
| 2009/0166093 | A1 * | 7/2009 | Pessier | E21B 17/1092 175/335 |
| 2009/0218140 | A1 * | 9/2009 | Pessier | E21B 10/28 175/57 |
| 2010/0252326 | A1 * | 10/2010 | Bhome | E21B 10/28 175/53 |
| 2010/0326741 | A1 | 12/2010 | Patel | |
| 2011/0079440 | A1 | 4/2011 | Buske et al. | |
| 2011/0315452 | A1 * | 12/2011 | Buske | E21B 10/14 175/336 |
| 2013/0133954 | A1 * | 5/2013 | Mohon | E21B 10/28 175/345 |
| 2014/0338979 | A1 | 11/2014 | Gunsaulis | |
| 2014/0338984 | A1 * | 11/2014 | Maher | E21B 10/25 175/336 |
| 2016/0305189 | A1 | 10/2016 | Lubberger et al. | |
| 2019/0360274 | A1 * | 11/2019 | Tian | E21B 10/20 |
| 2019/0368273 | A1 * | 12/2019 | Guerra | E21B 7/28 |
| 2020/0346980 | A1 | 11/2020 | Halderman et al. | |
| 2022/0228441 | A1 * | 7/2022 | Guerra | E21B 10/265 |

FOREIGN PATENT DOCUMENTS

| | | | | |
|---|---|---|---|---|
| CN | 108360979 | A * | 8/2018 | |
| DE | 1119194 | B * | 12/1961 | E21B 10/08 |
| GB | 2385081 | | 6/2003 | |
| WO | WO-2009086287 | A2 * | 7/2009 | E21B 10/28 |
| WO | WO-2013040408 | A2 * | 3/2013 | E21B 10/25 |

OTHER PUBLICATIONS

Copenheaver, Blaine R., Written Opinion of the International Searching Authority for PCT/US2019/034446, dated Aug. 2, 2019, 7 pages, ISA/US, Alexandria, Virginia.

Cherrington, Martin, How the HDD Industry Began, published at least as early as Feb. 12, 2003, 4 pages, http://www.trenchlessdataservice.com/library/dbhistory.htm.

* cited by examiner

HORIZONTAL DIRECTIONAL REAMING

TECHNICAL FIELD

The disclosure relates to the field of horizontal directional drilling or reaming techniques and equipment for drilling holes or boreholes for installation of pipe underground or under obstacles, such as a body of water.

BACKGROUND

Cone-shaped drill bits or cones or cutters have been used to make bore or hole enlargement tools called reamers or hole openers. A split-bit reamer is a type of reamer featuring cones or cone drill bits. The split-bit reamer is a tool often of larger diameter and is of particular use in horizontal directional drilling applications.

Some examples of prior art cone drill bits and split-bit reamers are shown in FIG. 1, FIG. 2 and FIG. 3.

FIG. 1 shows a typical drill bit third (i.e. of a tri-bit drill head) or reamer cone and arm/leg, which is cutting element with an arm and a rotating cone. The intersection of the dashed lines M & N shows the center of rotation O for the cone along the tool axis of rotation or axle. The typical drill bit third or reamer cone represented is rounded at its apex (i.e. at a distance D which does not coincide with the center of rotation of a prior art split-bit reamer).

FIG. 2 shows five cones of drill bits mounted forming a split-bit reamer. Each drill bit cone represented in FIG. 2 (five shown) is a solid body and is not segmented and it may have or not surface lines or grooves showing a step-like exterior substantially conical body all as one unitary body upon which the cutting teeth are mounted in rows. The center of rotation of one of the five cone drill bits is marked in the drawing with a plus (+) sign X (located off-center of the center of rotation Y of the reamer). The center of rotation of the reamer Y along its axis of rotation is also marked with a plus (+) Y sign (located as the center of the reamer) in the drawing. The center of rotation of the drill bit cone X (O in FIG. 1) is distant from the center of rotation Y for the reamer leading to friction of drag. The distance between the center of rotation of a cone X (or O) and the center of rotation of the reamer Y becomes more exaggerated or greater the larger the diameter of the reamer tool.

FIG. 3 shows a typical internal bearing mechanism between an arm of a split-bit reamer cutter and the typical cone. The bearing mechanism can only feature small, weaker bearings proximate the apex of the cone due to the shape of the cone (i.e. the narrow area or volume proximate the apex of the cone due to its angularity only allows room for smaller and/or shorter cylindrical bearings).

The prior art cones and split-bit reamer create mechanical inefficiency at the cones. The drill bit cones do not and cannot match at each respective row of teeth the rotational speed of the overall reamer around their axles, and hence the tangential speed at the cone surface of the drill bit cone cannot be efficiently matched or correlated with the tangential speed due to the rotation around the longitudinal axle of the split-bit reamer as further described below.

When a cone drill bit rotates around the axle of a reamer due to the application of a force on the tool, e.g. via drilling mud/fluid, (this force is the driving factor for the reamer to drill through earth, ground or rock), every tooth on the cone will have a tangential speed, determined by the angular speed or rotational speed of the cone. Since the tangential speed depends on the angular speed and the radius, due to the triangular cross-sectional shape of the cone, the teeth that are farther away or mounted at a greater radial distance from the axle of the cone will have a higher tangential speed than the teeth close to the "tip" of the cone. The teeth located at a farther distance from the axle, i.e. the ones close to the "base" of the cone and referred to as gauge teeth, will create a higher momentum than the teeth located closer to the axle of the cones, i.e. the teeth closer to the "tip" of the cone, once a friction force is created in between each respective tooth and the earth, ground or rock that is being drilled (reamed).

Due to this momentum's difference, the gauge teeth will establish the rotational speed of the cone, trying to match their tangential speed around the cone's axle with the tangential speed according to their position on the reamer. This creates significant mechanical inefficiency. The teeth closer to the tip of the cones do not have enough tangential speed around the cone's axle to match the tangential speed established by the rotation of the reamer. As a consequence of this inefficiency, the teeth successively and relatively closer to the tip of the cones have imperfect contact with the earth, ground, or rock which causes teeth to slide or drag over the rock, inefficiently scratching or scrapping its surface and often ineffectively drilling or crushing the earth, ground, or rock. The inefficiency may be especially disruptive in situations where the geological material being reamed comprises rock or hard rock. The mechanical inefficiency giving rise to scratching or scraping action, instead of a crushing action, causes teeth successively and relatively closer to the tip of the cones to become flat (worn) sooner than the gauge teeth.

When teeth become flat, the rate-of-penetration ("ROP") of the reamer or the speed at which the reamer drills through the earth, ground or rock decreases. When the ROP reaches the minimum acceptable value, it forces the driller or operator to trip out the reamer to change it with another unit. The lifetime of the reamer and the ROP of the reamer are negatively affected by this mechanical inefficiency. Additionally, the greater the distance between the center of rotation of a cone and the center of rotation of the reamer, the greater or more pronounced is the mechanical inefficiency.

BRIEF SUMMARY

The desired concept of reaming the earth, ground, or rock with drill bits or reamer heads should be that every tooth will be pushed against the rock producing a crushing effect, and that the combination of the rotational movement plus the injection of drilling fluid at high speed will evacuate the pieces of crushed rock, called cutting, leaving the surface of the rock clean for the next tooth to repeat the process. The present disclosure relates to embodiments of horizontal directional drilling equipment and methods for horizontal directional drilling techniques which more efficiently achieve the desired crushing effect.

The present disclosure relates to embodiments of an improved reamer head or apparatus for reaming an underground arcuate path having a reaming head in one embodiment as a frustoconical or truncated cone, or conical frustum shape or substantially frustoconical, truncated cone, conical frustum shape, or frustoconical body. An imaginary apex of the frustoconical body is superimposed on the centerline of a reamer or reaming apparatus for reaming of an underground arcuate path.

Further, the present disclosure relates to embodiments of a reamer apparatus for reaming an underground arcuate path or split-bit reamer featuring in one embodiment a plurality of improved reamer heads having a frustoconical, truncated cone, or conical frustum shape or substantially frustoconical, truncated cone, or conical frustum shape.

Additionally, the present disclosure relates to embodiments of an improved bearing mechanism for a reamer arm and reamer head.

The present disclosure also relates to embodiments of an apparatus for reaming an underground arcuate path or roller cone reamer head or progressive independently segmented reaming head.

BRIEF DESCRIPTION OF DRAWINGS

The embodiments may be better understood, and numerous objects, features, and advantages made apparent to those skilled in the art by referencing the accompanying drawings. These drawings are used to illustrate only typical embodiments of this invention, and are not to be considered limiting of its scope, for the invention may admit to other equally effective embodiments. The figures are not necessarily to scale and certain features and certain views of the figures may be shown exaggerated in scale or in schematic in the interest of clarity and conciseness.

DETAILED DESCRIPTION OF EXEMPLARY EMBODIMENTS

The description that follows includes exemplary apparatus, methods, techniques, and instruction sequences that embody techniques of the inventive subject matter. However, it is understood that the described embodiments may be practiced without these specific details.

Figure 4:
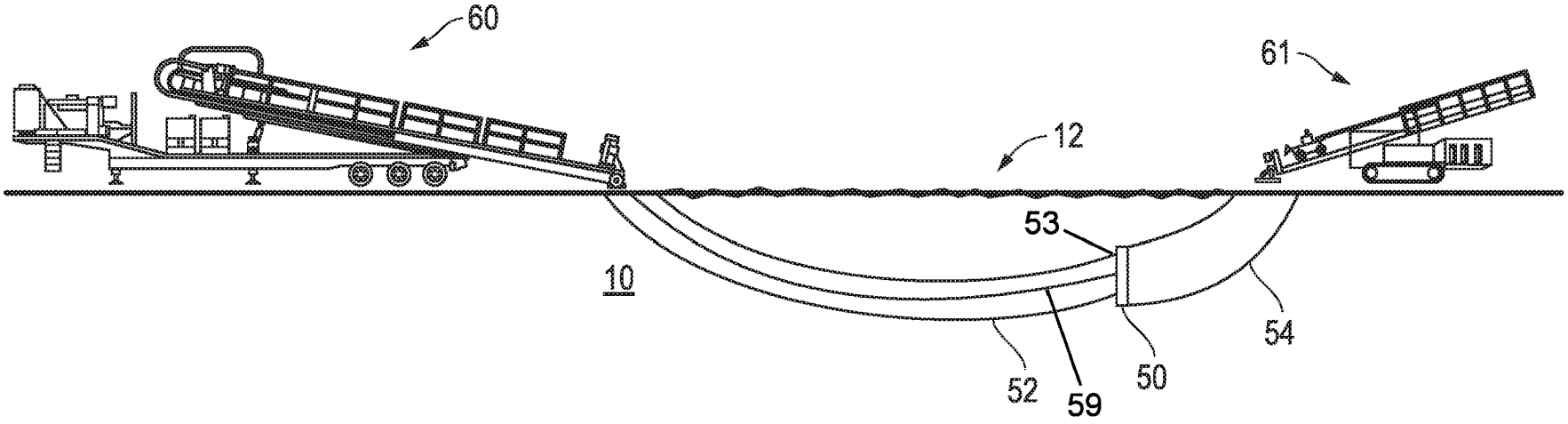
FIG. 4 depicts a schematic elevation view of an exemplary embodiment of a reamed hole crossing along an underground arcuate path after a prior drilled and/or reamed hole crossing.

Referring to FIG. 4, the hole 52 is reamed by the reamer 50 to make a larger hole 54. A pilot hole (not shown or potentially 52) is drilled to begin a crossing. The pilot hole may be reamed after drilling to make an intermediate or relatively larger hole 52. The intermediate hole 52 is reamed against walls 53 by reamer 50 to make a larger hole 54. The reamer 50 was dispatched from the rig 61 opposite drilling rig 60 and drills the arcuate path or crossing 54 through the earth 10 and may cross beneath an obstacle 12 such as, for example, a body of water, a transportation way, etc.

Figure 5:
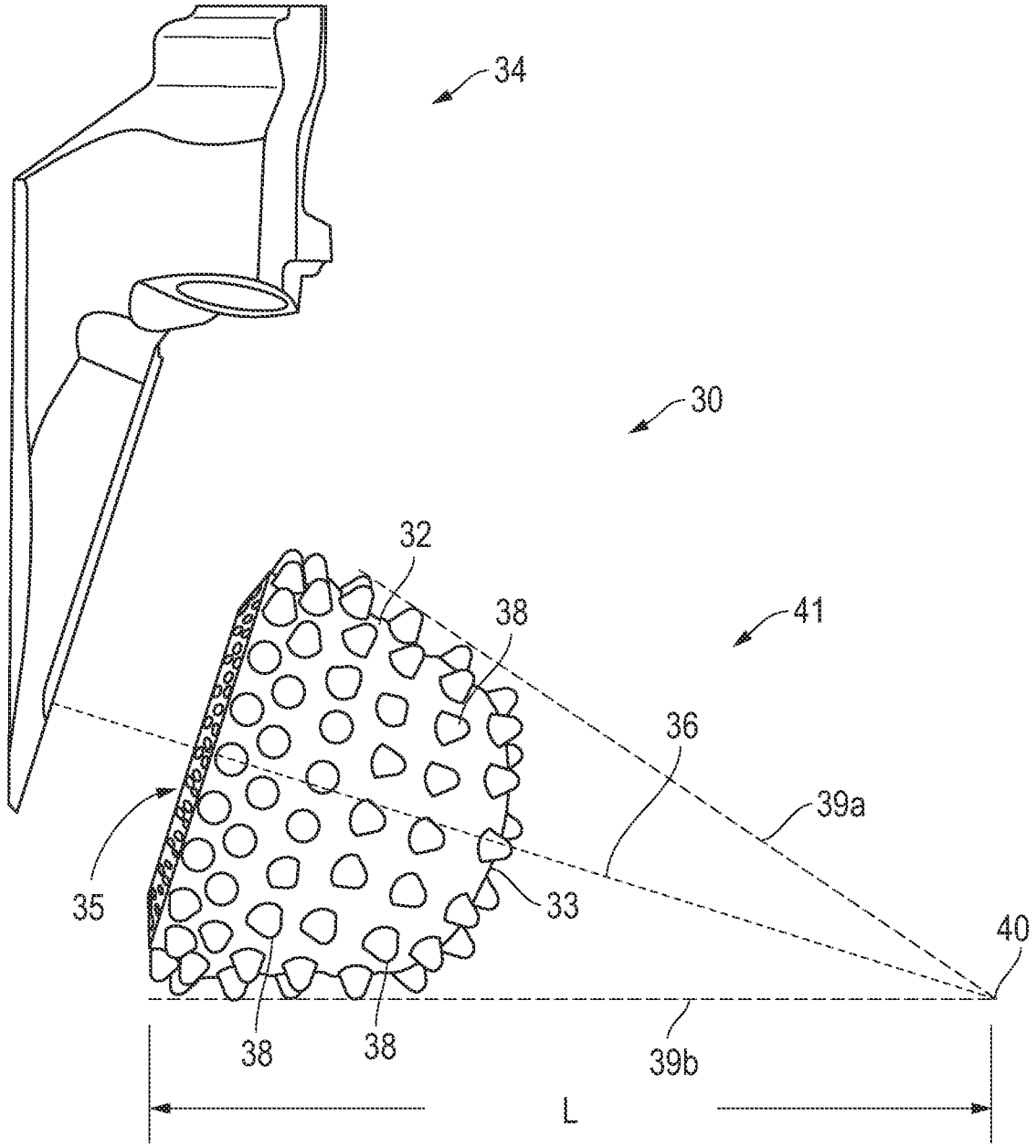
FIG. 5 shows an exploded view of an exemplary embodiment of an improved reaming head and arm.

FIG. 5 shows an exploded view of an exemplary embodiment of an improved reamer head 30 and split-bit reamer arm 34. The improved reamer head 30 has a frustoconical, truncated cone (via truncated end 33), or conical frustum shape or substantially frustoconical, truncated cone, conical frustum shape, or frustoconical body 32. The improved reamer head 30 has teeth 38. The improved reamer head 30 rotates about its center axis 36 and has center of rotation, located at its imaginary/geometrical apex 40, which can/will align with the center of rotation or centerline 56 of a split-bit reamer (not shown in FIG. 5, but represented in FIG. 6 or 7) for reducing friction/drag externally as the reamer 50 moves into/through the hole 52 and circumferentially reams surrounding walls 53 (causing friction/drag) to create a larger hole 54. The imaginary/geometrical apex 40 is the apex of imaginary/geometrical conical surfaces 39*a*, 39*b* of improved reamer head 30. The imaginary/geometrical conical surfaces 39*a*, 38*b* may be an imaginary/geometrical projection or extrapolation based upon the shape (e.g. frustoconical, truncated cone, or conical frustum shape or substantially frustoconical, truncated cone, or conical frustum shape) of improved reamer head 30 (or more specifically of frustoconical body 32) and defines an imaginary/geometrical conical shape 41. As the radius of the frustoconical or truncated conical body 32 varies along its height, the imaginary/geometrical apex 40 (omitted from the frustoconical body 32) can be matched to or mounted to be coincidental with (or superimposed upon) the center of rotation at 40 (along centerline 56) of the fully assembled reaming apparatus. Each reamer head 30 defines a center cavity or bore 35 (generally shown in FIG. 5 and FIG. 9) for mounting on arm 34 that may accommodate bearings 92, 94, 96 (see FIG. 9) or have a bearing surface (not shown) for mounting on and rotation about the arm 34.

In FIG. 5, in one embodiment, the frustoconical body 32 may be about sixty-five to seventy-five percent relative to the size or volume of a full cone (i.e. as defined by the imaginary/geometrical conical shape 41).

Figure 6:
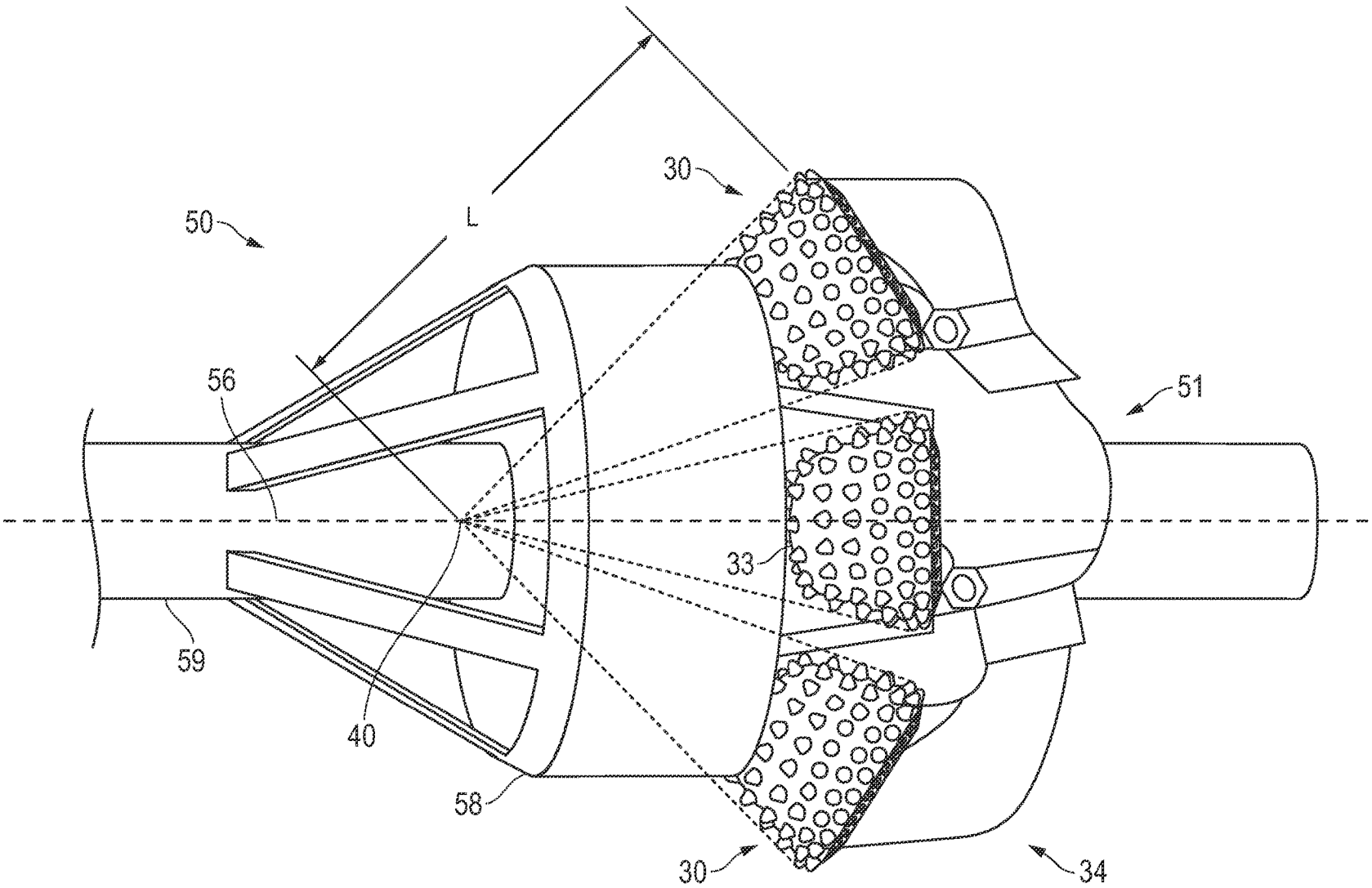
FIG. 6 shows a perspective view of an exemplary embodiment of a split-bit reamer or reaming apparatus featuring mounted improved reaming heads.

FIG. 6 shows a perspective view of an exemplary embodiment of a split-bit reamer or reaming apparatus 50 featuring mounted improved reaming heads 30. The split-bit reamer 50 may be attached to a reamer line 59 through which muds or drilling fluids (not shown) travel. The exemplary embodiment of the split bit reamer 50 shown usually has a centralizing ring or shroud 58 connected to the body 51 of the split-bit reamer 50, with a plurality of arms 34 extending from the body 51, wherein an improved reaming head 30 is mounted to each of the plurality of arms 34. The split-bit reamer 50 rotates about its centerline or central axis 56 (defined by the split-bit reamer 50 and/or the reamer line 59).

Figure 7:
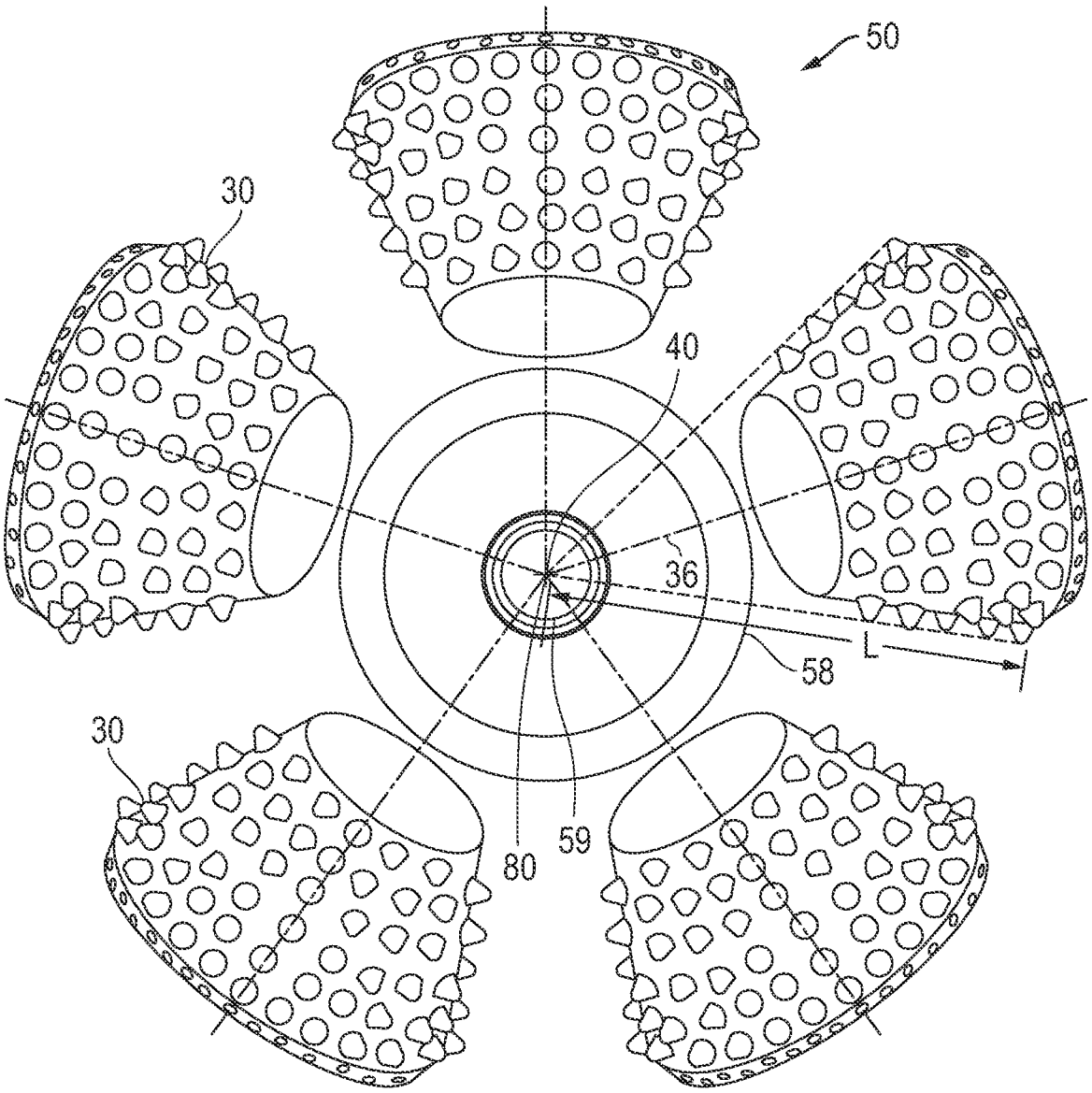
FIG. 7 shows a schematic view along the axis of rotation of an exemplary embodiment of a split-bit reamer featuring mounted improved reaming heads.

FIG. 7 shows a schematic view along the axis of rotation of an exemplary embodiment of a split-bit reamer 50 featuring mounted and symmetrically arranged improved reaming heads 30 and centralizing ring 58. The center of rotation 40 (along axis 36) for each of the improved reaming heads 30 aligns or coincides (i.e. at a distance L represented in FIG. 5) with the center of rotation of the reamer 80 along the reamer centerline axis 56 (shown in FIG. 6). In other words, the center axis 36 of each respective reaming head 50 intersects the reamer centerline axis 56 coinciding with the imaginary apex 40 at center of rotation of the reamer 80.

Figure 1:
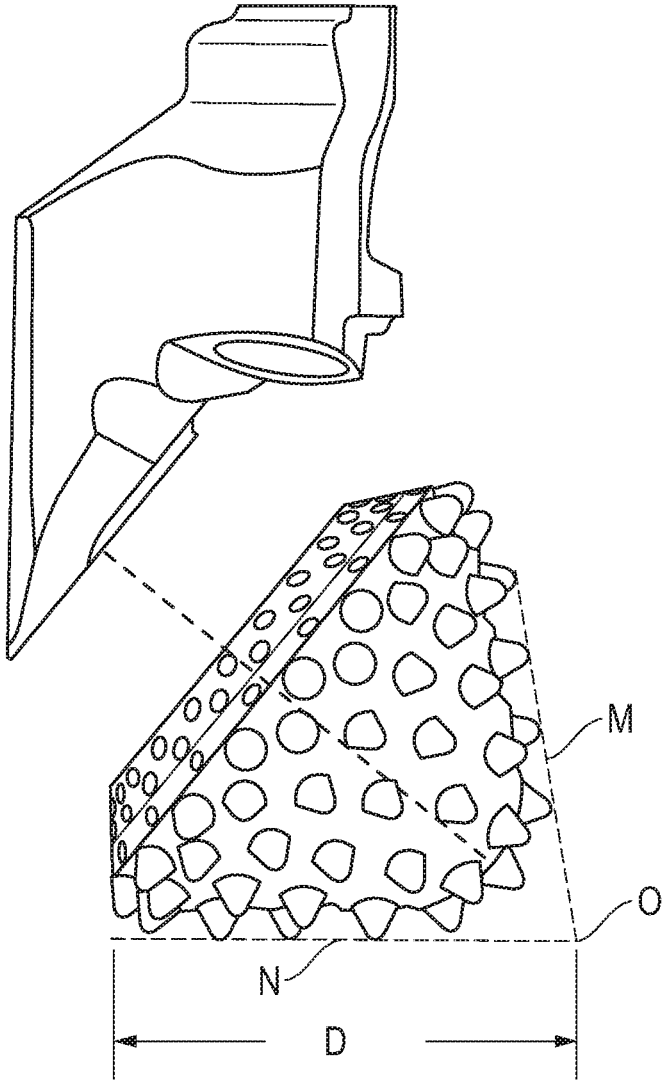
FIG. 1 (Prior Art)
FIG. 1 shows an exploded view of a 'Prior Art' drill bit and arm.
Figure 2:
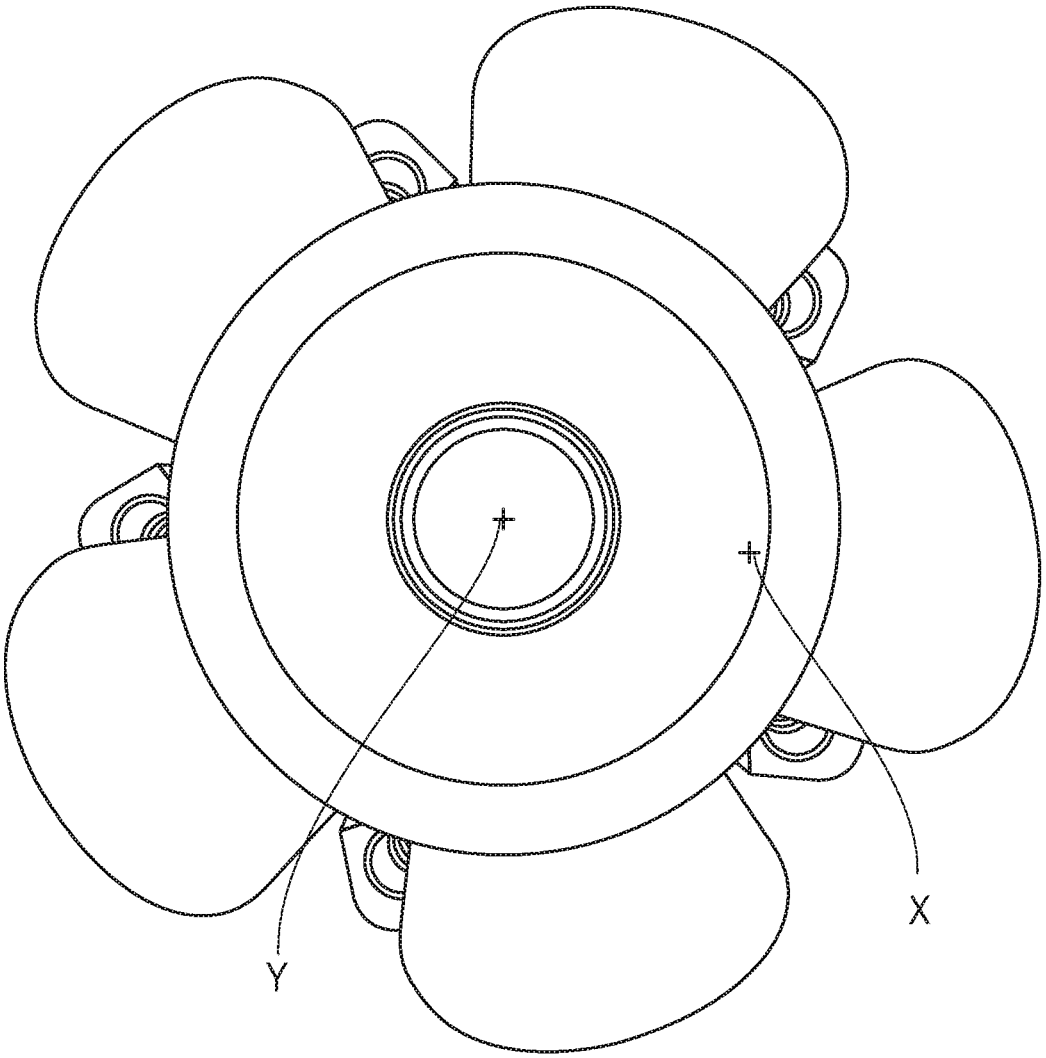
FIG. 2 (Prior Art)
FIG. 2 shows a schematic view along the axis of rotation of a 'Prior Art' reaming apparatus or reamer having drill bit cones as reaming heads.
Figure 8:
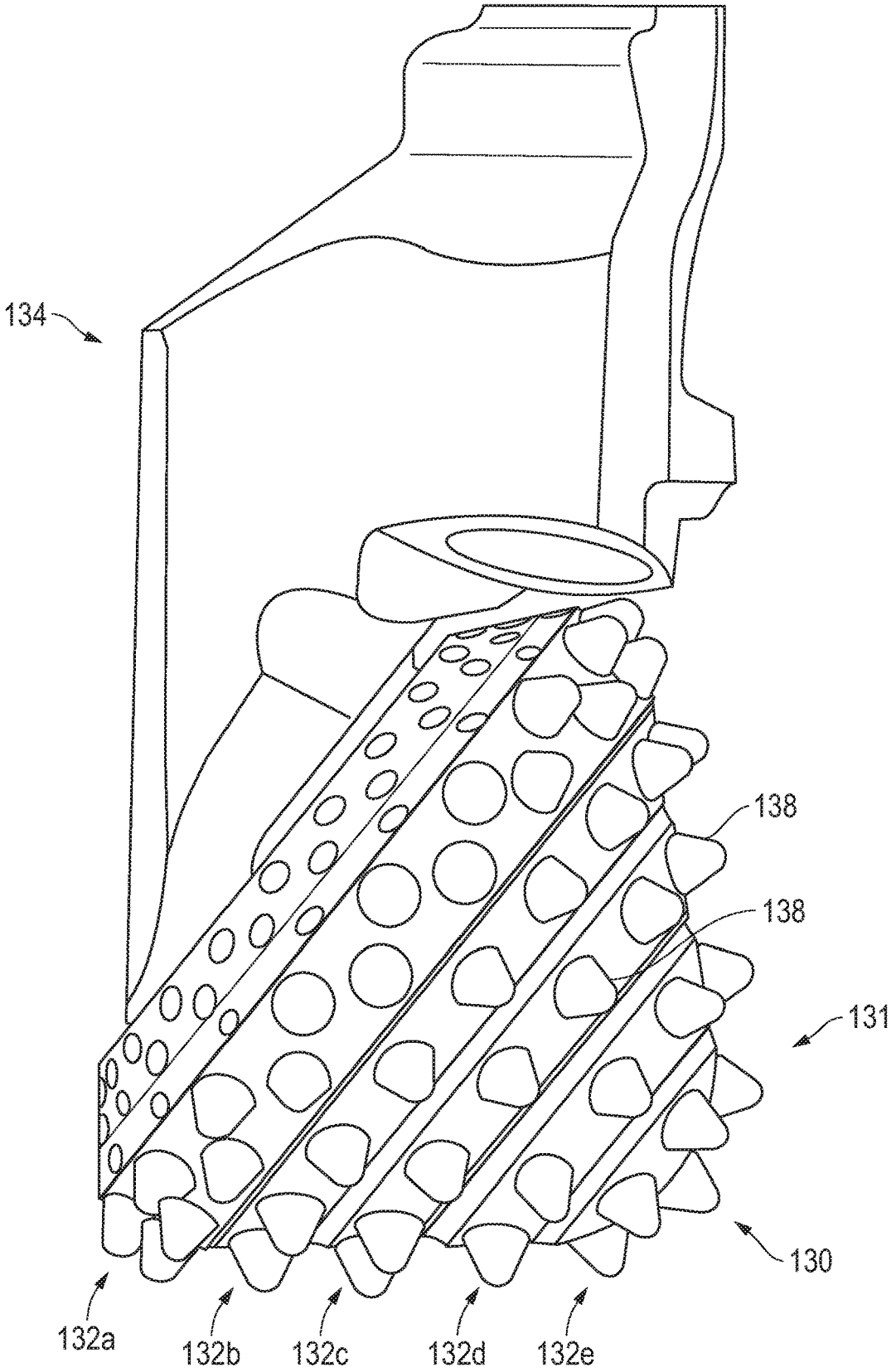
FIG. 8 shows a side view of an exemplary embodiment of a progressive independently segmented reaming head mounted to an arm of a split-bit reamer.

FIG. 8 shows a side view of an exemplary embodiment of a progressive independently segmented reamer head 130 mounted to an arm 134 of a split-bit reamer (not shown but mounted similar as represented in FIG. 2). This exemplary embodiment of a progressive independently segmented reaming head 130 comprises stacked, annular segments or pieces 132 which are collectively mounted to form a cone or conical shape or substantially cone shape 131. Each of the respective stacked, annular segments or pieces 132*a-e* may each be truncated cones or frusto-conical shaped or conical frustums all varying sequentially in radius along the height of the progressive independently segmented reamer head 130. The segment 132*e* at the apex of the cone shape 131 or the tip of the reamer head may be conical or substantially conical (or may alternatively annular similar to other segments, yet having the smallest radius that varies along its height). The stacked pieces 132 have a consecutively larger diameter along the height or length of the reamer head 130 (starting from the apex) and independently rotate on a center shaft (not shown) in forming the cone-shaped 131 progressive independently segmented reaming head 130. Each of the independently rotational and stacked annular truncated conical segments 132*a-e* respectively has a plurality of teeth 138 mounted thereon. Each of the respective stacked, annular segments or pieces 132*a-e* has a center bore (not shown) for mounting on arm 134 that may accommodate bearings (not represented in FIG. 8) or have a bearing surface (not shown) for mounting on and rotation about the arm 134. It is to be appreciated that each of the respective stacked, annular segments or pieces 132*a-e* may independently rotate (subject to any frictional forces) for reducing friction/drag externally as the reamer 50 moves into/through the hole 52 and circumferentially reams walls 53 (causing friction/drag) to create a larger hole 54.

Figure 3:
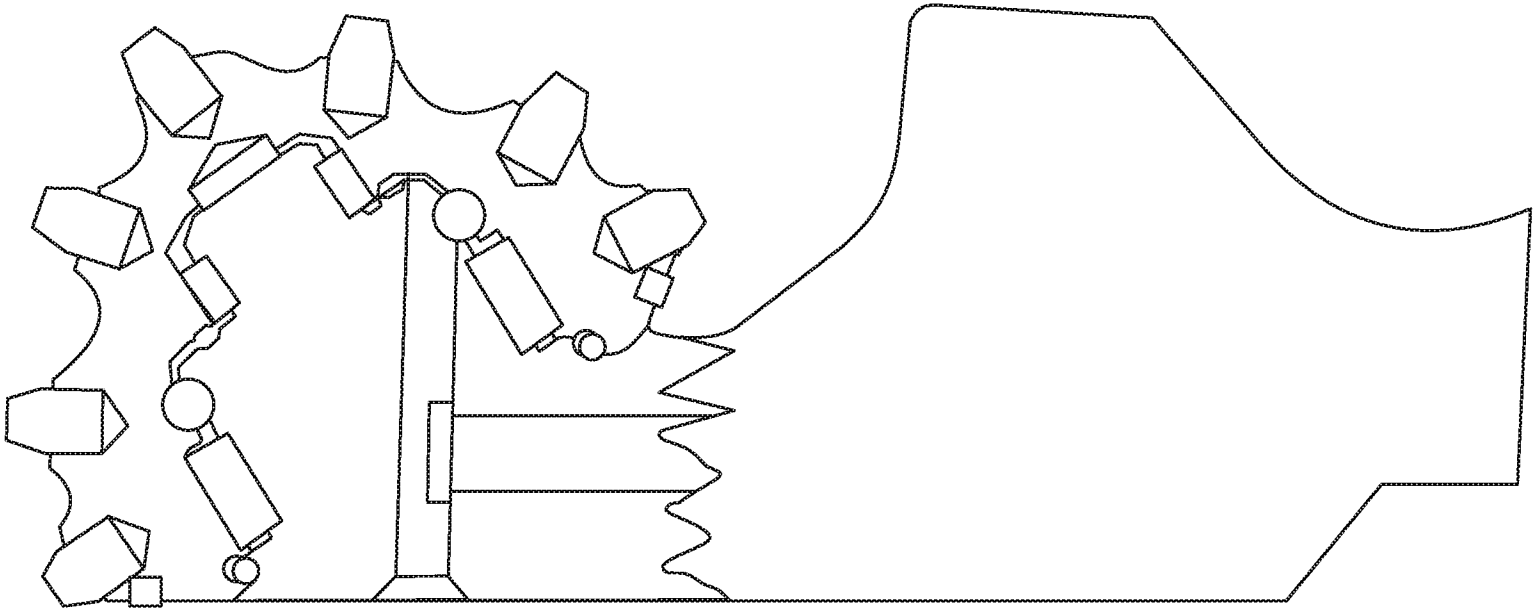
FIG. 3 (Prior Art)
FIG. 3 shows a partial sectional view of a 'Prior Art' bearing mechanism in combination with a drill bit cone as a reaming head.
Figure 9:
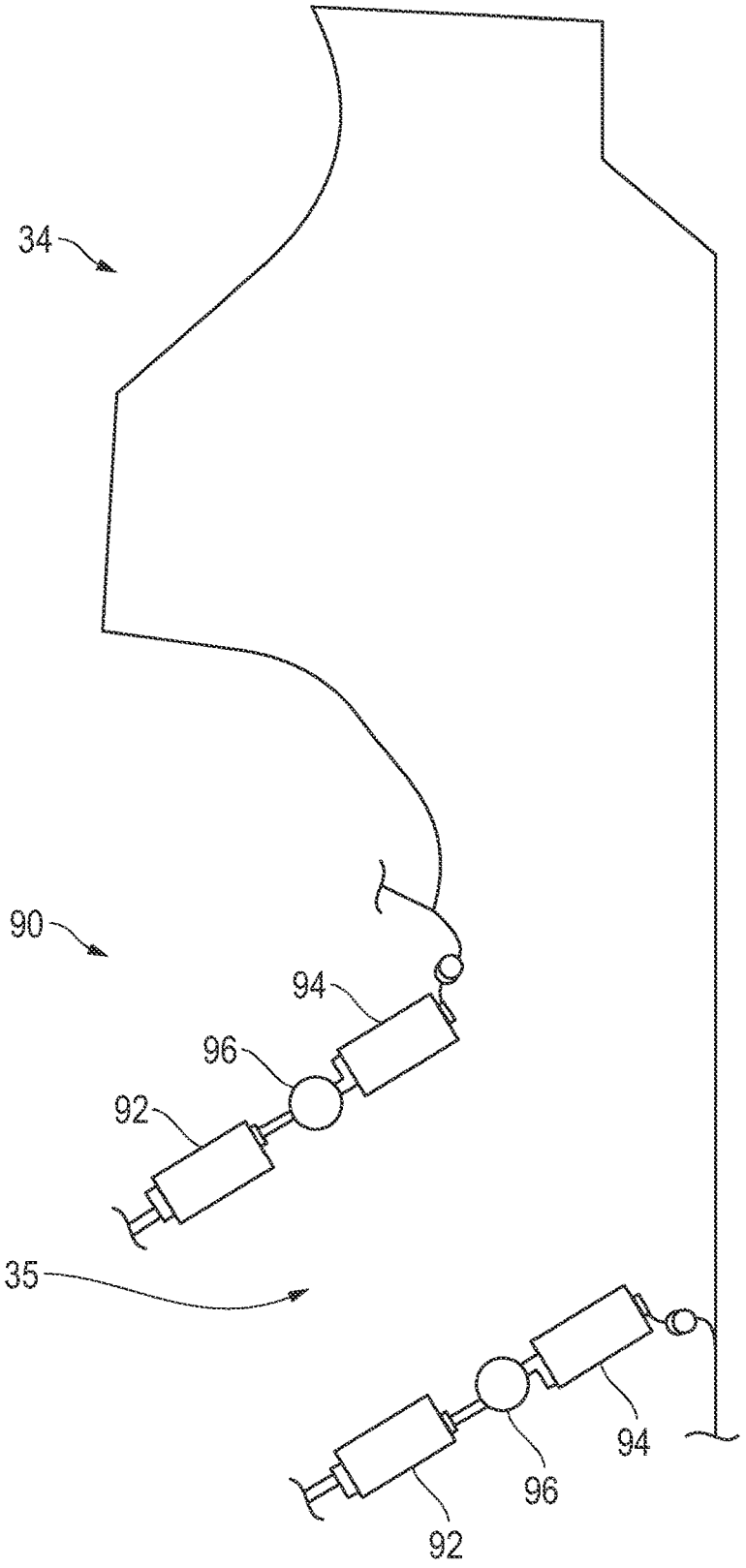
FIG. 9 shows a partial sectional view of an exemplary embodiment of an improved bearing mechanism 90 between an arm 34 of a split-bit reamer (not shown) and an improved reaming head (not shown).

FIG. 9 shows a partial sectional view of an exemplary embodiment of an improved bearing mechanism 90 between an arm 34 of a split-bit reamer 50 (shown in FIG. 7) for mounting of an improved reaming head 30 (shown in FIG. 5). The improved bearing mechanism 90 in this sectional view includes an upper cylindrical bearing 94 and a lower cylindrical bearing 92, and in one embodiment, each of the cylindrical bearings 92, 94 being the same size or substantially the same size (this is to be contrasted with FIG. 3 and its related discussion above; note in FIG. 9 bearing 92 is relatively longer as compared/contrasted to FIG. 3 bearings proximate the apex due to the reduction of angularity in the embodiments of FIGS. 5, 6, 7 & 9, e.g. by way of example only, 5°-25° reduction of angularity). The angularity and design of the bearings is matched to fit the embodiments represented in FIGS. 5-7. The length of the upper cylindrical bearing 94 relative to the lower cylindrical bearing 92 is not necessarily drawn to scale in FIG. 9 but shown schematically and it is to be appreciated they may be of substantially the same length and/or width.

It is understood that the present disclosure is not limited to the particular applications and embodiments described and illustrated herein, but covers all such variations thereof as come within the scope of the claims. While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

The reference numbers in the claims are not intended to be limiting in any way nor to any specific embodiment represented in the drawings, but are included to assist the reader in reviewing the disclosure for purposes of a provisional filing.

The invention claimed is:

1. An apparatus for horizontal directional drilling reaming an underground arcuate path after a pilot hole has been drilled, comprising:

a reamer line defining a centerline axis;

a body comprising a centralizing ring, a plurality of arms connected to the centralizing ring, and a plurality of reamer heads, one each of the reamer heads respectively mounted and corresponding to one each of the plurality of arms;

wherein the body is connected to the reamer line for centering the horizontal directional drilling reaming apparatus in the underground arcuate path;

wherein the plurality of reamer heads are symmetrically arranged around the centralizing ring;

a plurality of teeth mounted to each reamer head, wherein each of the plurality of teeth is configured to rotate and ream the underground arcuate path;

wherein each of the reamer heads comprises a frustoconical body;

wherein the frustoconical body defines a cavity configured to receive at least one bearing;

wherein the plurality of teeth are mounted to the frustoconical body;

wherein the frustoconical body is truncated across one end; and wherein the frustoconical body defines a geometrical apex projecting beyond the truncated end that coincides with the centerline axis of the horizontal directional drilling reaming apparatus for reaming a relatively larger diameter hole wherein the frustoconical body has an increased rate-of-penetration, and wherein the plurality of teeth mounted on the frustoconical body have an increased mechanical efficiency including any teeth relatively and successively closer to a tip of each reamer head, for the horizontal directional drilling reaming of the underground arcuate path.

2. The apparatus for horizontal directional drilling reaming the underground arcuate path after a pilot hole has been drilled according to claim 1, wherein the frustoconical body is sixty-five to seventy-five percent of the size relative to a conical body defined by the geometrical apex.

3. The reamer apparatus for horizontal directional drilling reaming an underground arcuate path after a pilot hole has been drilled of claim 1, further comprising:

a plurality of cylindrical bearings respectively mounted between each of the respective arms and each of the respective reamer heads within the cavity, wherein the cavity has a truncated cone profile, wherein the truncated cone profile accepts at least two levels of the plurality of cylindrical bearings, wherein the level of cylindrical bearings proximate a truncated end is substantially the same size as the other level due to a geometrical apex as determined by the truncated end.

4. The apparatus for horizontal directional drilling reaming the underground arcuate path after a pilot hole has been drilled according to claim 1, wherein the frustoconical body of each of the reamer heads defines a geometrical conical surface having a distance L; wherein the geometrical apex is located at the distance L; wherein the centerline axis coincides with the distance L; and wherein the geometrical apex is superimposed upon the centerline axis at the distance L.

5. A method for horizontal directional drilling reaming an underground arcuate path with an assembled horizontal directional drilling reaming apparatus, comprising the steps of:

drilling a pilot hole;

rotating a plurality of reamer heads wherein the plurality of reamer heads are symmetrically arranged around a centralizing ring in a body of the assembled horizontal directional drilling reaming apparatus; and horizontal directional drilling reaming through the pilet hole for reaming the underground arcuate path having a relatively larger diameter hole whilst reducing friction external of the reaming heads between the reaming heads and a surrounding wall of the underground arcuate path, whilst increasing the rate-of-penetration in reaming the relatively larger diameter hole, and whilst increasing the mechanical efficiency of a plurality of teeth mounted to each reamer head including any teeth relatively and successively closer to a tip of each reamer head, by each of the plurality of reamer heads comprising a frustoconical body wherein each frustoconical body defines a geometrical apex projecting beyond a truncated end of each frustoconical body that coincides with a centerline axis of the assembled horizontal directional drilling reaming apparatus.

6. The method for horizontal directional drilling reaming the underground arcuate path according to claim 5, further comprising:

wherein the frustoconical body defines a geometrical conical surface having a distance L;

wherein the geometrical apex is located at the distance L; wherein the centerline axis coincides with the distance L; and wherein the geometrical apex is superimposed upon the centerline axis at the distance L.

* * * * *